US006192614B1

(12) United States Patent
Cliburn

(10) Patent No.: US 6,192,614 B1
(45) Date of Patent: Feb. 27, 2001

(54) VIDEO MOUNTING SYSTEM FOR FIREARM

(76) Inventor: Daniel Cliburn, Norcross, GA (US)

( * ) Notice: Subject to any disclaimer, the term of this patent is extended or adjusted under 35 U.S.C. 154(b) by 0 days.

(21) Appl. No.: 09/359,514

(22) Filed: Jul. 23, 1999

(51) Int. Cl.[7] ..... F41C 27/00
(52) U.S. Cl. ..... 42/106
(58) Field of Search ..... 42/100, 103, 101; 89/41.05; 33/245–250, 266

(56) References Cited

U.S. PATENT DOCUMENTS

| | | | | |
|---|---|---|---|---|
| 3,785,261 | | 1/1974 | Ganteaume . | |
| 3,911,451 | | 10/1975 | Vockenhaber . | |
| 4,290,219 | | 9/1981 | Boller et al. . | |
| 4,309,095 | * | 1/1982 | Buckley | 354/81 |
| 4,835,621 | * | 5/1989 | Black | 358/335 |
| 5,020,262 | | 6/1991 | Pena . | |
| 5,887,375 | * | 3/1999 | Watson | 42/106 |
| 6,070,355 | * | 6/2000 | Day | 42/106 |

* cited by examiner

*Primary Examiner*—Peter M. Poon
*Assistant Examiner*—Christian M Best
(74) *Attorney, Agent, or Firm*—William B. Noll

(57) ABSTRACT

A video camera mounting system for a firearm, such as a rifle or a shotgun, to simultaneously video a target at the time of the "kill". The system includes a video mounting assembly that incorporates a shock absorbing mechanism to protect the video camera against the recoil of the firearm, and a pivotally mounted platform to finely adjust the video camera toward the target.

6 Claims, 3 Drawing Sheets

VIDEO MOUNTING SYSTEM FOR FIREARM

FIELD OF THE INVENTION

This invention is directed to the field of video camera mounting systems for a firearm, such as a rifle, that incorporates a shock absorbing mechanism to protect the camera from a "recoil" of the firearm.

BACKGROUND OF THE INVENTION

The present invention relates to a video camera mounting system for a rifle, and the like, that allows the user, i.e. hunter, to videotape the scenery or game being sought. The invention includes a shock absorbing mechanism that protects the video camera from impact of the rifle's recoil.

The use of photography equipment employing telephoto lenses for photographing wildlife is well known in the art, however, using a camera with a rifle in combination with a telescope is only a recent development. The general combination of a photographic means secured to a firearm is reflected in the following U.S. Patents:

a.) U.S. Pat. No. 5,887,375, to Watson, teaches a camera mount for firearms. The mount comprises a base plate; an intermediate plate operatively attached to the base plate; a dampening material, operatively attached between the base plate and the intermediate plate, for dampening recoil forces transmitted to the intermediate plate; and a mounting plate removably attached to the intermediate plate. The mounting plate includes a camera attachment device for allowing attachment of a camera to the mounting plate; and an adjustment mechanism, operatively connected between the intermediate plate and the mounting plate, for allowing the camera to be aligned with respect to the firearm. The camera mount further includes a firearm mounting device, operatively attached to the base plate, for mounting the camera mount to the firearm.

b.) U.S. Pat. No. 5,020,262, to Pena, discloses a camera mount for use on a telescope in combination with a rifle. The mount is clamped onto the telescope, and has a camera attached to the top of the mount. A cable mechanism is attached at one end to the shutter release of the camera and at the other end to the trigger of the rifle. The camera is arranged to photograph the image received through the telescope and reflected through the mount. The cable mechanism provides means for controlling the operation of the camera. A housing is clamped onto the telescope and has an eyepiece which fits onto the eyepiece of the telescope and contains a split prism which is positioned in the eyepiece at an angle such that it can be seen through for viewing the image of the target received through the telescope. The split prism has a reflective surface on one side which reflects the image of the target upwardly to a first surface mirror positioned in the housing above the split prism at an angle such that it receives the image reflected from the split prism, and then reflects the image forwardly to a second surface mirror. A second surface mirror is positioned at the forward end of the housing and at an angle that it receives the image reflected from the first surface mirror, and then reflects the image upwardly to the camera lens. The image of the target is photographed when the trigger of the rifle is pulled.

c.) U.S. Pat. No. 4,835,621, to Black, related to a video camera recording device having a gunstock and a support structure which includes a mounting platform adapted to receive thereon a hand held video camera recorder having a lens structure defining a line of sight, a recording medium for recording video information, and a viewfinder and mounting structure for mounting the viewfinder onto the gunstock. Structure is provided for effecting a sequential activating and deactivating of the video camera recording device for the purpose of starting a recording of video information onto the recording medium and stopping the recording, respectively. A gun sight is located in the line of sight so as to be visible through the viewfinder when the video camera recorder is recording video information on the recording medium. A trigger is provided on the gunstock and is adapted to be manually activated by a finger of a user'hand. A signal generator is provided which generates a signal visible through the viewfinder in response to the user activating the trigger. The signal is also simultaneously recorded on the recording medium.

d.) U.S. Pat. No. 4,309,095, to Buckley, teaches a camera mounting device for mounting a camera to a hunting rifle. The device comprising a first mounting bracket adapted to support a camera, a threaded fastener to detachably secure a camera to the first bracket, a variable diameter clamp to clamp the first mounting bracket to the barrel of the telescope sight of a rifle, a cable release for remote actuation of the camera, a second mounting bracket connected to the cable release, and threaded fasteners for detachably securing the second mounting bracket to the trigger guard of a rifle so that actuation of the cable release is coordinated to actuation of the rifle trigger.

e.) U.S. Pat. No. 4,920,219, to Boller, et al., disclosed a rifle having a telescopic sight for recording the target as seen through the telescopic sight at the instant the trigger is pulled. The apparatus includes a beam splitter for directing to a camera some of the light passing through the telescopic sight. The shutter mechanism of the camera is coupled to the rifle trigger so that the camera will "shoot" the picture of the target when the trigger is pulled. The camera is of the instant-copy type so that pictures of the target can be viewed shortly after "shooting". The apparatus thus enables the ability of a rifleman to be tested without the need for firing live ammunition.

f.) U.S. Pat. No. 3,911,451, to Vockenhuber, relates to a telescopic gun sight with a mount for a removable camera to enable an object to be photographed through the telescope. The light path from the telescope to the camera is provided by a beam splitter which separates some of the light traveling along the optical axis of the telescope and diverts it towards a collimator and a window in the wall of the telescope. The collimator provides parallel rays from this diverted light so that the camera attached to the mount can be a fixed focal-length camera. An arrangement is provided for blanking off the window when the camera is not fitted to the telescope.

g.) U.S. Pat. No. 3,785,261, to Ganteaume, teaches an apparatus adapted to make an immediate record as by a photograph of a theoretical hit such as in hunting wild game. There is disclosed both a mechanical and an electrically actuated means for causing this theoretical hit to be exposed on the film of a camera which is carried by and actuated with the pulling of the trigger of the gun. The distance, trajectory and windage factors are reflected in this photographic record. The hunter using the gun fires a blank cartridge rather than a real cartridge so that this photographic record indicated what results this hunter would have achieved had a real bullet been fired.

While the prior art presents a number of alternatives to video recording of a target or potential "kill", the respective alternatives are generally complex and less user friendly than found in the present invention. The manner by which the invention hereof offers an effective solution to providing the user, i.e, hunter, with the opportunity to target a potential "kill", will become apparent to those skilled in the art from the following description, particularly when read in conjunction with the accompanying drawings.

SUMMARY OF THE INVENTION

This invention relates to a vertical elevationally, adjustable, video camera mounting assembly for a firearm, such as a rifle or shotgun, where the firearm features an extended barrel. This allows the user, i.e. hunter, to video image a target during aiming and firing of the firearm. The assembly comprises a pair of opposing mounting plates, one for each side of the firearm, to be secured thereagainst by plural fastening members overriding and underriding the firearm. A first mounting plate, on a face opposite to the firearm, includes a horizontally movable shock absorbing mechanism, where the mechanism is intended to react to and absorb the recoil action of the firearm. A third, essentially planar plate is secured to the shock absorbing element, where a rear end thereof mounts a laterally extending pivotal rod. Finally, a video camera supporting base member is provided and secured to the pivotal rod. The base member includes means for mounting a video camera, and an angularly and forwardly extending arm operable with means on the forward end of the third plate to adjust the vertical elevation of the base member. By this arrangement, the video camera may be spatially adjusted for alignment with the extended barrel.

Accordingly, an object of this invention is the provision of a video camera mounting system for a firearm, that includes a pivotal adjustment member to accurately align the camera towards a target, and a shock absorbing mechanism to protect the camera against the recoil of the firearm.

Another object hereof is provision of a stable mounting assembly having primary and secondary securing means.

These and other objects will become apparent, particularly to those skilled in the art, from the following specification.

DETAILED DESCRIPTION OF PREFERRED EMBODIMENT

Figure 1:
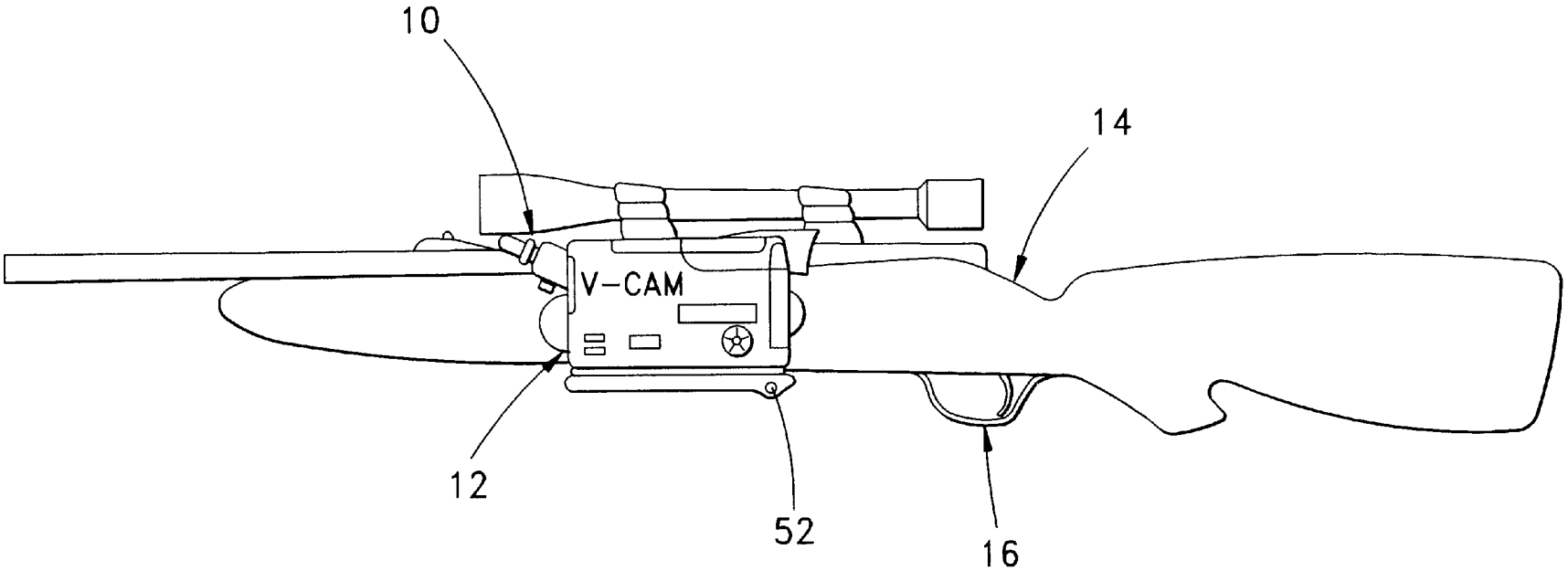
FIG. 1 is a side view of a conventional firearm, such as a rifle, having attached thereto the video camera mounting assembly according to the present invention.

The present invention is directed to a video camera mounting assembly for a firearm, such as a rifle or shotgun, to allow a "hunter" to video his target. The assembly will now be described with regard to the several Figures, where like reference numerals represent like components or features throughout the various views.

Figures 2, 4:
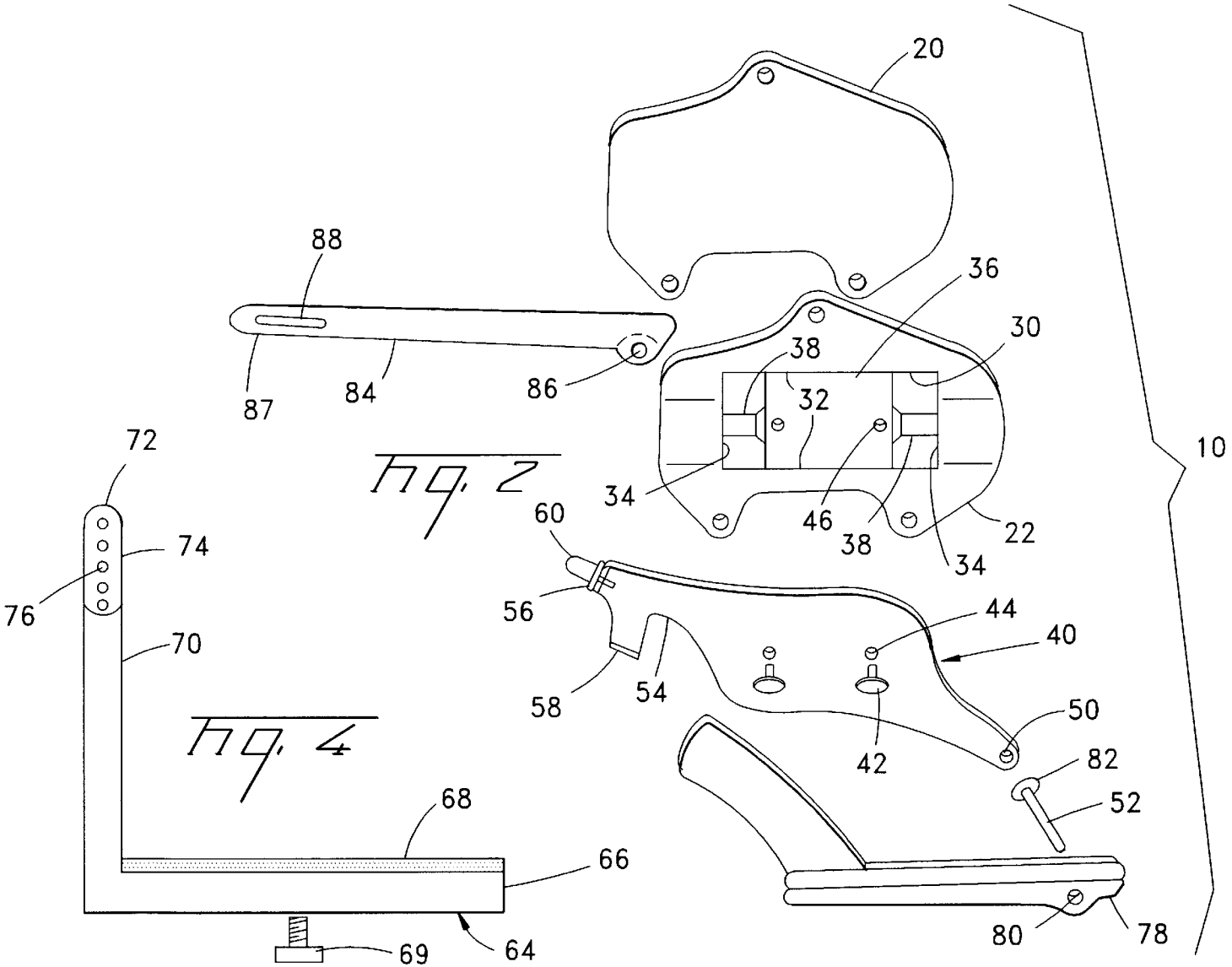
FIG. 2 is an exploded perspective view of the assembly hereof illustrating the various components of the assembly.
FIG. 4 is a front view of the video camera mounting base, the outer most component shown in FIGS. 2 and 3, further showing an exploded threaded member for securing the camera to the base.
Figure 3:
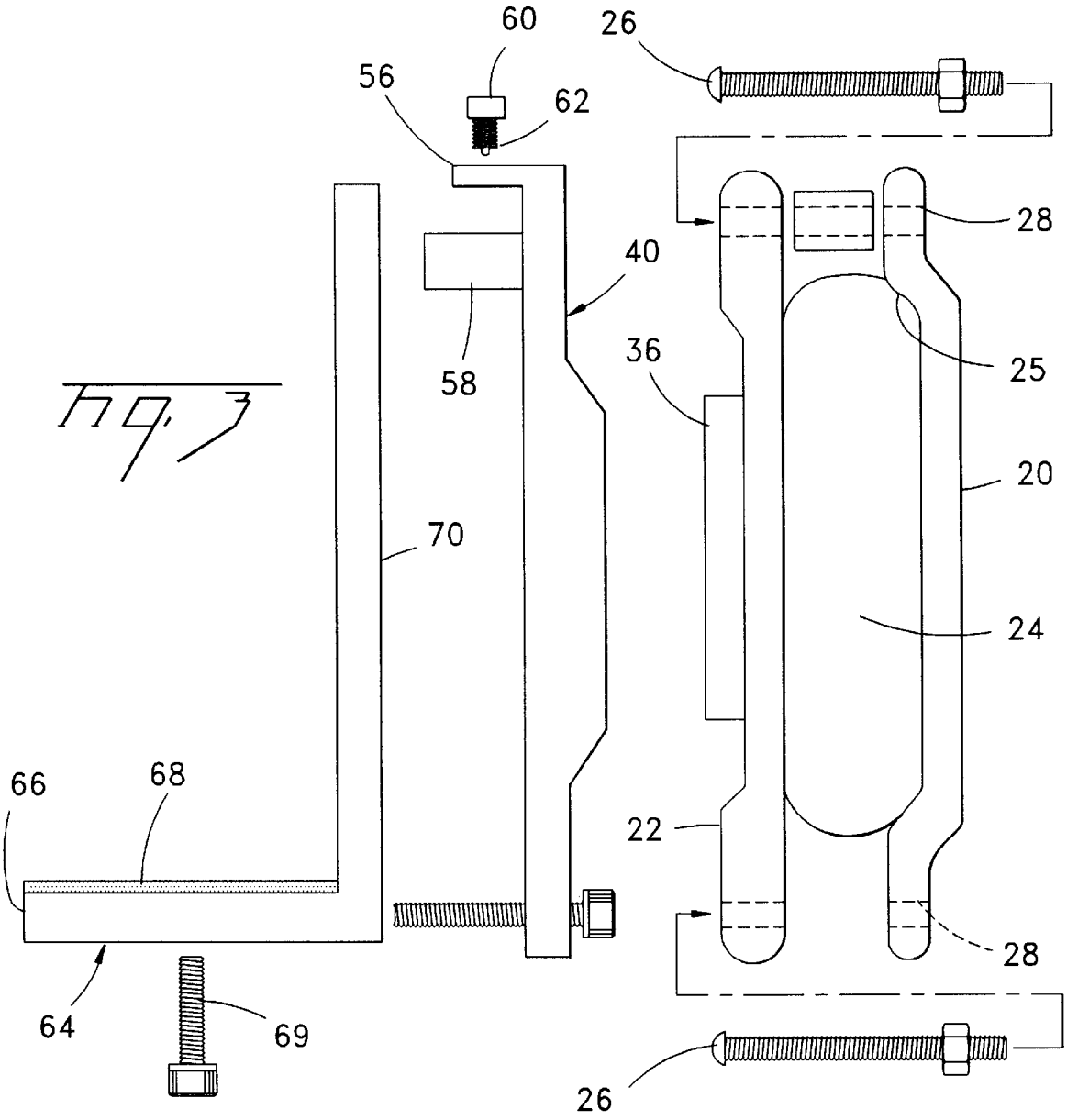
FIG. 3 is an exploded rear view of the components shown in FIG. 2, further showing the relationship of the assembly to the firearm.

FIG. 1 illustrates the assembly 10 mounting a conventional video camera 12, where the assembly is shown secured to a rifle 14 at a point forward the trigger 16. The assembly 10, and the components illustrating same are best shown in FIGS. 2 and 3. The assembly 10 comprises first and second mounting plates 20, 22, respectively, for sandwiching the gun stock 24 therebetween, by plural fastening members 26, through aligned apertures 28 (FIG. 2), where at least said first mounting plate 20 is contoured 25 to better cradle the gun stock.

A unique feature of this invention is the provision of a shock absorbing system to compensate for the recoil of the rifle to protect the camera. In a preferred embodiment, the second mounting plate 22 includes a horizontally oriented, shallow recess 30 defined by a upper and lower walls 32 and a pair of side walls 34. Mounted for sliding movement along the upper and lower walls 32 is a shock absorbing housing 36, where sliding movement of the housing 36 is controlled by opposing elements 38, which may be small air cylinders or a pair of compression springs.

For mounting to the shock absorbing housing 36 is an essentially planar elongated member 40 by means of a pair of thumb screws 42 passing through apertures 44 into threaded recesses 46 in the housing 36. Passing through an extension 48 at the rear thereof is a through opening 50 for receiving a pivotal rod 52, as explained hereafter. The opposite forward edge includes a planar extension 54 having first and second lateral projections 56, 58. The first said projection 56 mounts a spring biased pull knob 60 having a downwardly extending pin 62, the function of which be described hereafter with regard to the video mounting base 64.

The video mounting base 64 comprises a platform 66, preferably padded 68 for supporting the video camera 12, where the platform 66 includes a central aperture for receiving threaded member 69 which passes therethrough into threaded engagement with the video camera 12, as known in the art Extending vertically and forwardly from the platform 66 is a curved arm 70, where the free end 72 includes an edge 74 containing plural recesses 76, see FIG. 4. Finally, along the rear edge 78 of the platform 66 is a through opening 80 for receiving rod 52, where the inside end 82 of rod 52 is fixed in opening 50. By this arrangement, the mounting base 64 is free to pivot relative to elongated member 40. That is, it may be desirable to vertically adjust the mounting base 64, and hence the video camera 12, to align the camera to the rifle barrel. However, it is recognized that it may be prudent to provide a safety stop so that the camera does not pivot too far. In that regard, the second lateral projection 58 underlies the curved arm 70. To precisely adjust the assembly 10, the camera mounting platform 66 is slightly pivoted until the camera is aligned. Thereafter, the pull knob 60 is moved to initially recess the pin 62, then released into the appropriate recess 76. In this position the camera is ready to record the "kill".

To provide secondary support in mounting the assembly 10, an elongated, pivot member 84 is provided. A first end includes a through opening 86 for slidably engaging a lower fastening member 26 joining the first and second mounting plates 20, 22. The opposite end 87 includes a slot 88 for setting the pivot member relative to the barrel stock.

It is recognized that changes, variations and modifications may be made to the mounting assembly of this invention without departing from the spirit and scope of the invention. Accordingly, no limitation is intended to be imposed thereon except as set forth in the following claims.

What is claimed is:

1. A vertical elevationally adjustable video camera mounting assembly for a firearm, where said firearm includes an extended barrel, for video imaging a target during aiming and firing of said firearm, said assembly comprising:

a.) a pair of opposing mounting plates, one for each side of the firearm, to be secured thereagainst by plural fastening members overriding and underriding said firearm;

b.) a first said mounting plate, on a face opposite to the firearm, including a horizontally movable shock absorbing mechanism, where said mechanism is intended to react to and absorb the recoil action of the firearm;

c.) a third, essentially planar plate secured to said shock absorbing element, where a rear end thereof mounts a laterally extending pivotal rod, and a forward end; and d.) a video camera supporting base member secured to said pivotal rod, said base member including means for mounting a video camera, and an angularly and forwardly extending arm operable with means on said forward end to adjust the vertical elevation of said base member, whereby the video camera may be spatially adjusted for alignment with said barrel.

2. The video camera mounting assembly according to claim 1, wherein said forward end mounts a spring biased pull knob having a movable pin, and a free end on said angular arm including plural recesses, where said movable pin may be selectively positioned in the different said recesses to define an elevational position for said base member.

3. The video camera mounting assembly according to claim 2, wherein said forward end further includes a lateral extension to underlie said angular arm to limit the pivotal movement of said base member.

4. The video camera mounting assembly according to claim 1, wherein said first mounting plate includes a horizontally oriented recess for mounting said shock absorbing mechanism, and said shock absorbing mechanism includes a housing adapted for sliding movement within said recess, and a pair of opposing shock absorbing elements to control the sliding movement of said housing.

5. The video camera mounting assembly according to claim 1, wherein said base member includes a platform having a threaded aperture therein for receiving a fastening member engageable with said video camera.

6. The video camera mounting assembly according to claim 1, including a pivotal, essentially planar member mounted at a first end between said opposing mounting plates, where the opposite end of said member is secured to the underside of said extended barrel.

* * * * *